US005755054A

United States Patent [19]

Tuller

[11] Patent Number: 5,755,054

[45] Date of Patent: May 26, 1998

[54] TRIGGER BLOCKING DEVICE

[75] Inventor: Jeffrey Tuller, Rochester, N.Y.

[73] Assignee: Crosman Corporation, East Bloomfield, N.Y.

[21] Appl. No.: 824,276

[22] Filed: Mar. 26, 1997

[51] Int. Cl.[6] ..... F41A 17/00

[52] U.S. Cl. ..... 42/70.07; 42/70.11

[58] Field of Search ..... 42/70.07, 70.06, 42/70.11, 70.01

[56] References Cited

U.S. PATENT DOCUMENTS

| | | | |
|---|---|---|---|
| D. 196,842 | 11/1963 | Schaefer | 42/70.07 |
| 1,686,482 | 10/1928 | Windle | 42/70.07 |
| 2,893,152 | 7/1959 | Peluso | 42/70.07 |
| 3,066,433 | 12/1962 | Rogers et al. | 42/70.07 |
| 3,164,919 | 1/1965 | Hall | 42/70.07 |
| 3,422,560 | 1/1969 | Foote et al. | 42/70.07 |
| 3,616,559 | 11/1971 | Sobolewski | 42/70.07 |
| 3,616,669 | 11/1971 | Sobolewski | 42/70.07 |
| 3,624,945 | 12/1971 | Foote | 42/70.07 |
| 3,956,842 | 5/1976 | Ballenger | 42/70.07 |
| 4,499,681 | 2/1985 | Bako et al. | 42/70.07 |
| 4,509,281 | 4/1985 | Dreiling et al. | 42/70.07 |
| 5,050,328 | 9/1991 | Insko | 42/70.07 |
| 5,191,158 | 3/1993 | Fuller et al. | 42/70.07 |
| 5,309,661 | 5/1994 | Fuller et al. | 42/70.07 |
| 5,392,551 | 2/1995 | Simpson | 42/70.07 |
| 5,400,538 | 3/1995 | Shannon | 42/70.07 |
| 5,437,119 | 8/1995 | Womack | 42/70.07 |
| 5,450,684 | 9/1995 | Harris | 42/70.07 |
| 5,515,633 | 5/1996 | Harris | 42/70.07 |
| 5,535,537 | 7/1996 | Avganim | 42/70.07 |
| 5,535,605 | 7/1996 | Werner | 42/70.07 |
| 5,561,935 | 10/1996 | McCarthy et al. | 42/70.07 |

OTHER PUBLICATIONS

Photocopy of Package for DAC Technologies of America Gun Trigger Lock Date Unknown.

*Primary Examiner*—Charles T. Jordan
*Assistant Examiner*—Theresa M. Wesson

[57] ABSTRACT

A trigger blocking device includes a body, a cap, and a key. The body and cap include front and rear portions which are releasably connectable in front of and behind a trigger. The front of the body includes a plurality of flexible and resilient converging legs which extend away from the cap. The front of the cap includes a projection having a detent which is engageable with the legs for releasably locking the body and the cap together. The key includes fingers which are engageable with the legs to flex the legs out of engagement with the detent to unlock the body and the cap.

10 Claims, 3 Drawing Sheets

TRIGGER BLOCKING DEVICE

BACKGROUND AND SUMMARY OF THE INVENTION

This invention relates to a trigger blocking device, and, more particularly, to a trigger blocking device which requires a key in order to remove the blocking device.

Numerous devices have been designed for blocking or locking the trigger of a firearm or gun. Such devices should provide reliable blocking, should be removable only by an authorized person, should be adaptable for use with a variety of guns, and should be reusable.

The blocking device of the invention provides improved safety and versatility over prior devices. The device includes two parts which snap together to block the trigger, and the parts can be unlocked only with a special key. A spacer may be removably mounted on one of the parts for blocking the trigger. The size of the spacer can be selected to accommodate the particular gun involved. The interlocking parts are reusable.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
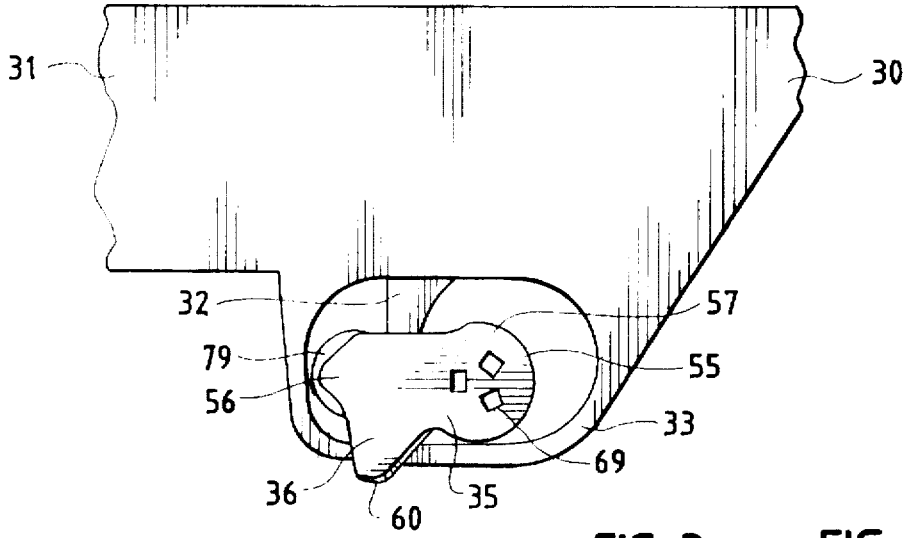
FIG. 1 is a fragmentary side view of a gun and a trigger blocking device which is formed in accordance with the invention.

Referring to FIG. 1, the numeral 30 designates generally a gun which includes a frame or receiver 31, a trigger 32, and a trigger guard 33. The right side of the gun is illustrated in FIG. 1, and the gun is fired by pulling the trigger rearwardly or to the left in FIG. 1.

A trigger blocking device 35 includes a cap 36, a body 37 (FIGS. 2–6), and a key 38 (FIGS. 2 and 12–15). As will be explained hereinafter, the cap and the body are locked together in FIG. 1 to block the trigger and to prevent the trigger from being pulled.

The body 37 includes a flat panel 40 having front and rear ends 41 and 42, a left outside surface 43, and a right inside surface 44. An opening 45 is provided in the rear portion of the body and is reinforced by an annular boss 46. The panel 40 includes a downwardly extending projection 47 below the opening 45 which extends below the trigger guard 33.

Figure 6:
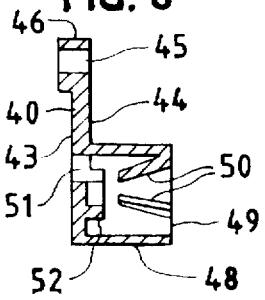
FIG. 6 is a sectional view taken along the line 6—6 of FIG. 3.
Figure 7:
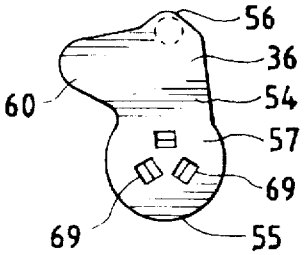
FIG. 7 is a right side view of the cap of the blocking device.
Figure 8:
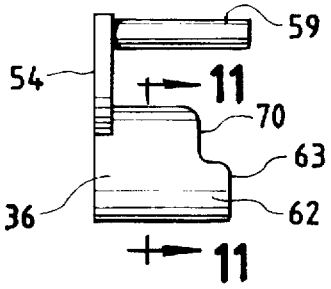
FIG. 8 is a top view of the cap.
Figure 9:
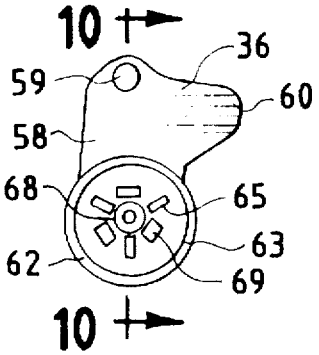
FIG. 9 is a left side view of the cap.
Figure 10:
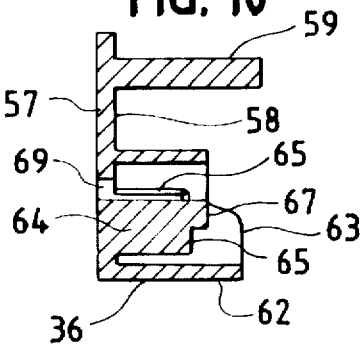
FIG. 10 is a sectional view taken along the line 10—10 of FIG. 9.

A cylindrical housing 48 extends inwardly, i.e., toward the right, from the panel 40 and includes an open inner end 49. Three legs 50 (FIG. 6) extend from the open end of the housing toward the panel 40 and converge toward the axis or centerline of the housing. The body is advantageously molded integrally from plastic, and the panel 40 is provided with openings 51 which permit the legs to be molded in a two-part mold. The area adjacent the openings is reinforced by an annular boss 52 (FIG. 6).

The cap 36 includes a flat panel 54 having front and rear ends 55 and 56 (see also FIGS. 7–10), a right outside surface 57, and a left inside surface 58. A spindle or pin 59 extends inwardly from the rear end of the panel, and the panel 54 includes a downwardly extending portion 60 below the spindle which extends below the trigger guard 33.

Figure 11:
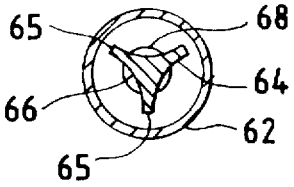
FIG. 11 is a sectional view taken along the line 11—11 of FIG. 8.
Figure 12:
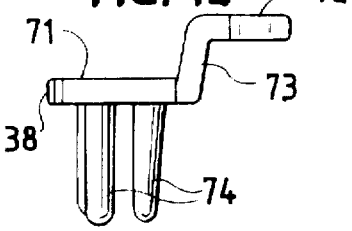
FIG. 12 is a top view of the key of the blocking device.
Figure 13:
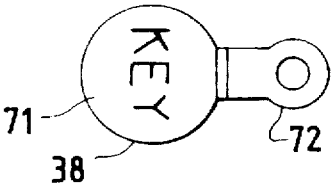
FIG. 13 is a right side view of the key of the blocking device.
Figure 14:
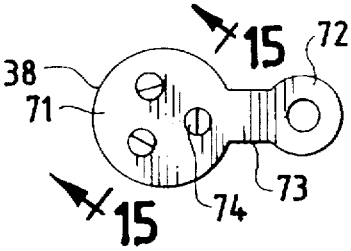
FIG. 14 is a left side view of the key of the blocking device.
Figure 15:
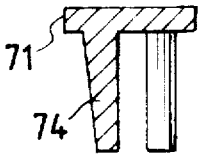
FIG. 15 is a sectional view taken along the line 15—15 of FIG. 14.

A cylindrical housing 62 extends inwardly, i.e., toward the left, from the panel 54 and includes an open inner end 63. A spider projection 64 (FIG. 11) extends axially inside of the housing 62 from the panel 54. The spider projection includes three radially extending ribs 65, arcuate valleys 66 between the ribs, a cylindrical inner end portion 67 (FIG. 16) which extends axially beyond the ribs, and a radially extending detent disc or plate 68 at the junction of the ribs and the plate. Three key holes 69 (FIGS. 7 and 10) are provided in the panel 54 in alignment with the valleys 66 between the ribs 65.

The housing includes a recessed portion 70 which is engageable with the panel 40 of the body when the cap and body are interlocked. The inner end of the spider projection 64 is also engageable with the panel 40 when the cap and body are interlocked.

The key 38 (FIGS. 2 and 12–15) includes a base panel 71, a finger tab 72 which is offset outwardly from the panel by a leg 73, and three fingers 74 which extend inwardly from the panel 71. As will be explained hereinafter, the fingers are sized to be inserted through the key holes 69 in the cap to unlock the cap and the body.

Figure 18:
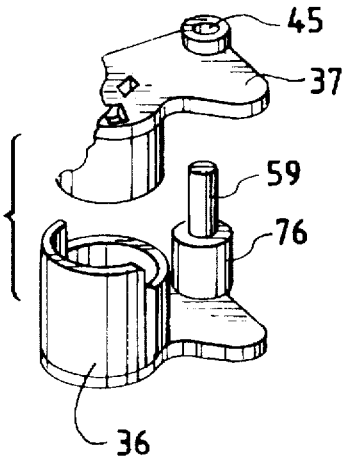
FIG. 18 is an exploded fragmentary perspective view of the cap and the body with a spacer on the cap
Figure 19:
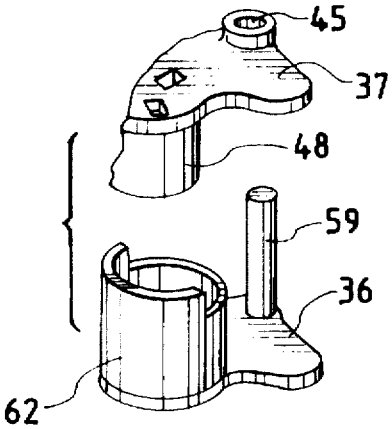
FIG. 19 is a view similar to FIG. 18 without the spacer.
Figure 20:
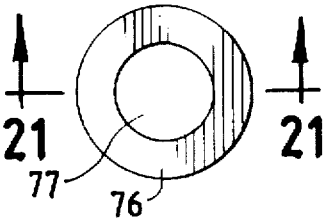
FIG. 20 is an end view of the spacer
Figure 21:
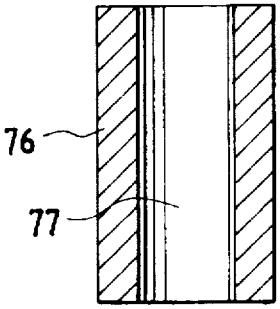
FIG. 21 is a sectional view taken along the line 21—21 of FIG. 20.
Figure 22:
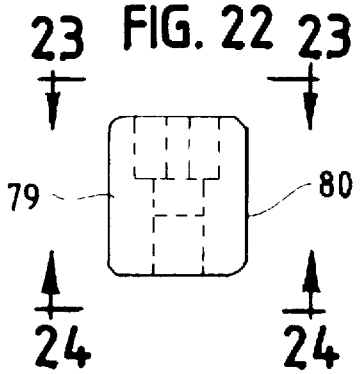
FIG. 22 is a top view of another spacer.
Figure 23:
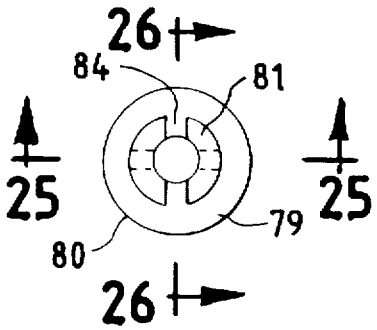
FIG. 23 is an end view of the spacer of FIG. 22.
Figure 24:
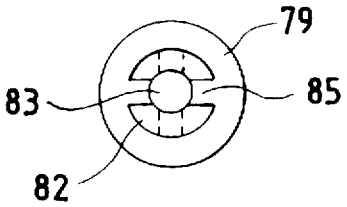
FIG. 24 is a view of the other end of the spacer of FIG. 22.
Figure 25:
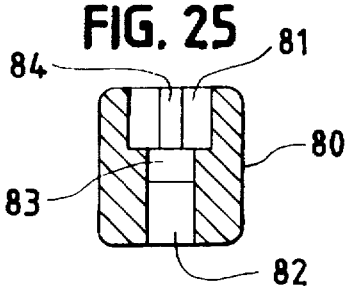
FIG. 25 is a sectional view taken along the line 25—25 of FIG. 23.
Figure 26:
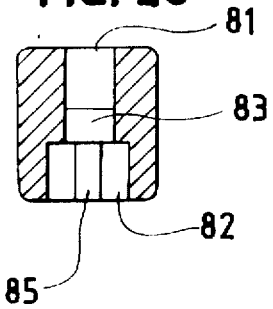
FIG. 26 is a sectional view taken along the line 26—26 of FIG. 23.

FIGS. 18, 20, and 21 illustrate a cylindrical spacer 76 which can be slidably and removably mounted on the spindle 59 of the cap 36 depending upon the spacing between the trigger 32 and trigger guard 33 of the particular gun on which the blocking device is used. The spacer is provided with a center opening 77 which is sized to snugly receive the spindle 59.

FIGS. 22–26 illustrate an alternate spacer 79 which has a bigger outside diameter than the spacer 76. The scale of FIGS. 22–26 is one-half of the scale of FIGS. 20–21.

The spacer 79 includes a cylindrical outer surface 80, a pair of axially extending openings 81 and 82, and a reduced-diameter center opening 83 which is sized to snugly receive the spindle 59. A pair of ribs 84 extend radially into the opening 81, and a pair of ribs 85 extend radially into the opening 82. The ribs 84 and 85 are offset by 90°, and the inside surfaces of the ribs are aligned with the outer diameter of the center opening 83.

The body and the cap are advantageously molded from glass-filled DELRIN® plastic. The spacers and the key are advantageously molded from polypropylene plastic.

Figure 2:
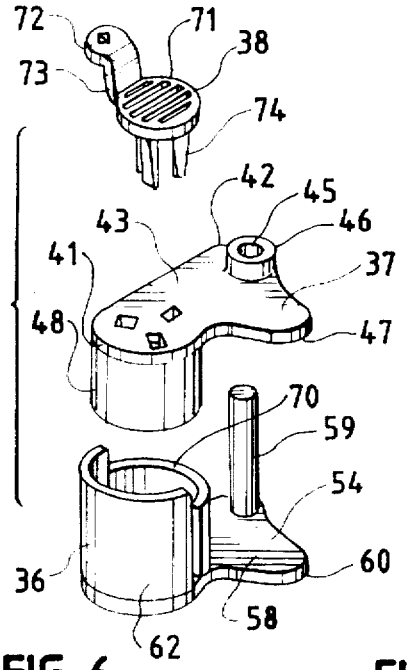
FIG. 2 is a fragmentary perspective view of the blocking device.
Figure 3:
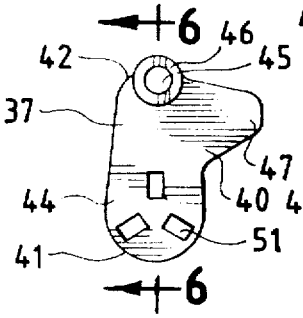
FIG. 3 is a left side view of the body of the blocking device.
Figure 4:
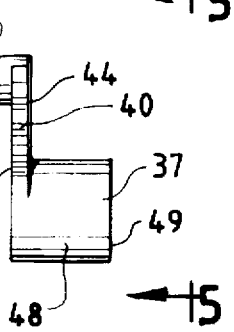
FIG. 4 is a top view of the body.
Figure 5:
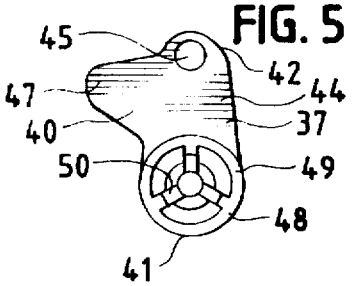
FIG. 5 is a right side view of the body taken along the line 5—5 of FIG. 4.

Referring to FIGS. 1 and 2, the cap 36 and body 37 are brought together over the right and left sides of the trigger 32 and trigger guard 33 so that the cylindrical housings 48 and 62 are positioned forwardly of the trigger. As the cap and body are moved toward each other, the housing 48 telescopes into the housing 62, and the spindle 59 slides into the opening 45. The outside diameter of the housing 48 is just slightly less than the inside diameter of the housing 62. The spindle 59 is sized to slide snugly into the opening 45 to connect the rear portions of the cap and body.

Figure 16:
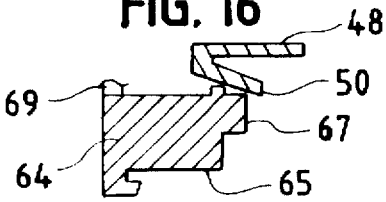
FIG. 16 is a fragmentary sectional view showing the cap and the body in the process of being locked together.

As the housing 48 slides into the housing 62, the cylindrical front end 67 and the detent disc 68 of the spider projection 64 engage the legs 50 and flex them radially outwardly (FIG. 16). When the detent disc 68 passes the ends of the legs, the resilient legs snap inwardly into the valleys 66 between the ribs 65 of the spider projection. The cap and the body are thereby locked together, since the detent disc 68 engages the ends of the legs 50 and prevents the parts from being separated.

If the space between the back of the trigger and the back of the trigger guard is small, the diameter of the spindle 59 alone may be sufficient to block the trigger from being pulled. If the space is larger, the small spacer 76 can be inserted over the spindle 59 to substantially fill the space between the trigger and the trigger guard. If the space is even larger, the large spacer 79 can be inserted over the spindle. A variety of different size spacers can be provided so that the blocking device can be used with substantially all models of guns.

The downwardly extending projections 47 and 60 on the body and the cap sandwich the trigger guard and stabilize the blocking device on the trigger guard. The space between the panels 40 and 54 of the body and cap is preferably just slightly wider than the width of the trigger guard when the recessed portion 70 of the housing 62 of the cap engages the plate 40.

The locking engagement between the legs 50 and the detent disc 68 is enclosed within the cylindrical housings 48 and 52. The lock is thereby protected from tampering.

Figure 17:
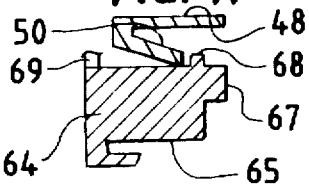
FIG. 17 is a fragmentary sectional view similar to FIG. 16 showing the cap and the body locked together.

The cap and body can be unlocked only by using the key 38. The fingers 74 of the key are inserted into the key openings 69 in the cap and pushed toward the legs 50 (see FIG. 17). As the fingers 74 engage the legs, the legs are pushed radially outwardly out of engagement with the detent plate 68, and the cap and body can be pulled apart.

The cap, body, and key are reusable. After the cap and body are separated to unblock the trigger, they can be relocked when it is desired to block the trigger again.

While in the foregoing specification a detailed description of specific embodiments of the invention were set forth for the purpose of illustration, it will be understood that many of the details herein given can be varied considerably by those skilled in the art without departing from the spirit and scope of the invention.

I claim:

1. A trigger blocking device comprising a body, a cap, and a key, the body including front and rear portions adapted to be positioned in front of and behind a trigger, the cap including front and rear portions adapted to be positioned in front of and behind a trigger, first connecting means on the front portion of the body and on the front portion of the cap for interconnecting the body and the cap, second connecting means on the rear portion of the body and on the rear portion of the cap for interconnecting the body and the cap, one of the first and second connecting means including means for releasably securing the body and the cap, said securing means including a plurality of flexible and resilient legs on one of the body and the cap and a detent on the other of the body and the cap which is engageable with said legs, said one of the body and the cap being provided with an opening and said legs being positioned around said opening, said detent being insertable into said opening, said key including a plurality of fingers which are engageable with said legs to flex the legs out of engagement with said detent, one of the body and the cap being provided with a key opening, the key being insertable into the key opening for releasing said securing means whereby the body and the cap can be disconnected.

2. The trigger blocking device of claim 1 in which said one of the body and the cap includes an inside surface which faces the other of the body and the cap, said legs converging in a direction which extends away from said inside surface, the other of said cap and body being provided with key openings for the fingers of the key, whereby the fingers of the key can be inserted into the key openings for flexing the legs out of engagement with said detent.

3. The trigger blocking device of claim 1 in which said securing means is mounted on the first connecting means, said second connecting means including a spacer removably mounted thereon which is adapted to be positioned behind the trigger for filling in a gap between said second connecting means and said trigger in order to block the trigger.

4. The trigger blocking device of claim 3 in which said second connecting means includes an elongated spindle on one of the body and the cap and a spindle opening on the other of the body and the cap, the spindle being insertable into the spindle opening.

5. The trigger blocking device of claim 1 in which one of said second connecting means includes an elongated spindle on one of the body and the cap and a spindle opening on the other of the body and the cap, the spindle being insertable into the spindle opening.

6. A trigger blocking device comprising a body, a cap, and a key, each of the body and the cap including front and rear portions adapted to be positioned in front of and behind a trigger, the body including a generally cylindrical housing having an open inner end which faces the cap and a plurality of flexible and resilient converging legs on the cylindrical housing which extend away from the open inner end and which terminate in outer ends, the cap including a projection which is insertable into the open inner end of the body and is engageable with said legs, the projection including a detent which is engageable with the outer ends of the legs, said key including a plurality of fingers which are insertable into the cap for engaging said legs to flex the legs out of engagement with said detent.

7. The trigger blocking device of claim 6 in which said cap includes an outer surface which is provided with key openings for the fingers of the key.

8. The trigger blocking device of claim 6 in which said housing is mounted on the front portion of the body and said projection is mounted on the front portion of said cap, and connecting means on the rear portions of the body and the cap for interconnecting the body and the cap and for blocking the trigger.

9. The trigger blocking device of claim 8 in which said connecting means includes a spacer removably mounted thereon which is adapted to be positioned behind the trigger for blocking the trigger.

10. The trigger blocking device of claim 9 in which said connecting means includes an elongated spindle on one of the body and the cap and a spindle opening on the other of the body and the cap, the spindle being insertable into the spindle opening.

* * * * *